United States Patent [19]

Cantada et al.

[11] 4,452,157

[45] Jun. 5, 1984

[54] BASTING STITCH MECHANISM

[75] Inventors: Edilberto Cantada, East Brunswick, N.J.; Anthony D. Spasiano, Old Greenwich, Conn.

[73] Assignee: The Singer Company, Stamford, Conn.

[21] Appl. No.: 369,431

[22] Filed: Apr. 19, 1982

[51] Int. Cl.[3] ..... D05B 69/00

[52] U.S. Cl. ..... 112/221; 112/220

[58] Field of Search ..... 112/221, 220

[56] References Cited

U.S. PATENT DOCUMENTS

| | | | |
|---|---|---|---|
| 3,559,601 | 2/1971 | Tullman . | |
| 3,779,187 | 12/1973 | Adams . | |
| 3,782,311 | 1/1974 | Adams et al. | 112/158 R |
| 3,872,809 | 3/1975 | Adams et al. . | |
| 4,129,084 | 12/1978 | Kihara | 112/221 |
| 4,246,855 | 1/1981 | Johnson | 112/221 |
| 4,325,313 | 4/1982 | Kawai et al. | 112/221 |

FOREIGN PATENT DOCUMENTS

| | | | |
|---|---|---|---|
| 535907 | 10/1931 | Fed. Rep. of Germany | 112/221 |
| 56-16679 | 4/1981 | Japan | 112/221 |

*Primary Examiner*—Werner H. Schroeder
*Assistant Examiner*—Steven N. Meyers
*Attorney, Agent, or Firm*—Edward P. Schmidt; Robert E. Smith; Edward L. Bell

[57] ABSTRACT

A basting stitch mechanism in which a latch is carried on the side of the needle bar carrier and is fashioned with a front portion extending in front of the needle bar terminating in a wedge, which wedge fits into a notch in a driving stud hinge pin extending about the needle bar and slidable thereon. The latch wedge connection to the driving stud eliminates the requirement for establishing a clearance between the needle bar carrier and the driving stud carrying the driving stud hinge pin. An extension spring connected between the sewing machine frame and a rear portion of the latch operates to increase the latching force as the needle bar is moved downwardly. By proper design of the wedge on the latch and the notch on the driving stud hinge pin, separation of the driving stud hinge pin from the latch may take place at some force designed to avoid breakage of the sewing needle.

5 Claims, 7 Drawing Figures

BASTING STITCH MECHANISM

BACKGROUND OF THE INVENTION

This invention is in the field of sewing machines; more particularly, it is concerned with an improved basting stitch mechanism for a sewing machine needle bar and gate arrangement.

In the prior art basting stitch mechanisms exemplified in U.S. Pat. Nos. 3,559,602; 3,782,311; and 3,872,809; a latch is pivoted on a needle bar carrier which is attached to the needle bar above a needle bar driving stud, the latch having an arm extending at right angles thereto which extends between the left front surface of the driving stud so as to provide a driving connection between the driving stud and the needle bar. However, the driving stud which is connected by a connecting rod to a crank mechanism is restrained to move rectilinearly only; while the needle bar in the above cited patents swings in an arc when progressing from left needle position to right needle position or vice versa. This difference in motion between the needle bar carrier attached to the needle bar and the driving stud restrained by the crank mechanism requires a clearance between the bottom of the needle bar carrier and the top of the driving stud in order to avoid an interference. The presence of this clearance allows an impact to take place during load reversals at either extreme of the needle bar travel, resulting in noise and wear. For purposes of obtaining this clearance, the latch is carried relative to the needle bar carrier on an eccentric which must be adjusted to provide the required clearance.

Also, it would be ideal in any needle bar to provide for release of the needle bar from the endwise reciprocation imparting mechanism in the event of a loading on the sewing needle approaching its breaking strength.

What is required is an improved basting stitch mechanism in which there is no necessity to set clearance to avoid noise and wear due to the impact between the needle bar carrier and the driving stud. Further, such an improved basting stitch mechanism should provide for release of the needle bar on encountering a loading which could cause needle breakage.

SUMMARY OF THE INVENTION

This invention eliminates the above noted drawbacks by utilizing a latch having a wedge shaped engaging surface co-operate with a notch in a driving stud hinge pin for a self-centering and self-aligning action in an arrangement in which the clearance is established in the initial design without the necessity for adjusting this gap to very tight settings. The latch is pivoted to the side of the needle bar carrier and is formed with a portion that extends in front thereof extending downwardly to the wedge facing inwardly to the driving stud hinge pin. The driving stud hinge pin which is carried by the driving stud is fashioned with a notch shaped to accommodate the wedge end of the latch. The clearance between the needle bar carrier and the driving stud is established in the initial design of the latch and no further adjustment is necessary or possible.

By proper design of the wedge and notch surfaces, to allow the wedge to slip out of the notch on the imposition of a load on the needle bar which could break the sewing needle, the basting stitch mechanism will also provide a safety function.

The latch may be actuated by overthrow of the needle bar as is disclosed in the U.S. patent application No. 239,834, filed on Mar. 2, 1981, or by a basting solenoid as is disclosed in U.S. Pat. No. 3,872,309 referred to above. If actuation of the basting mechanism is accomplished by overthrow of the needle bar a stationary link may be attached to the gate, which stationary link swings with the gate and strikes a movable link resiliently carried on the gate mounting bracket, the movable link thus contacting the latch follower to urge the latch to disengage the wedge from the driving stud hinge pin. The needle bar carrier and latch are retained in an elevated position by an extension spring which may also provide a biasing force for the latch, holding the latch in engagement with the driving stud hinge pin.

DESCRIPTION OF THE DRAWINGS

Invention accordingly comprises the constructions hereinafter described, the scope of the invention being indicated in the following claims. In the accompanying drawings:

DESCRIPTION OF THE INVENTION

Figure 1:
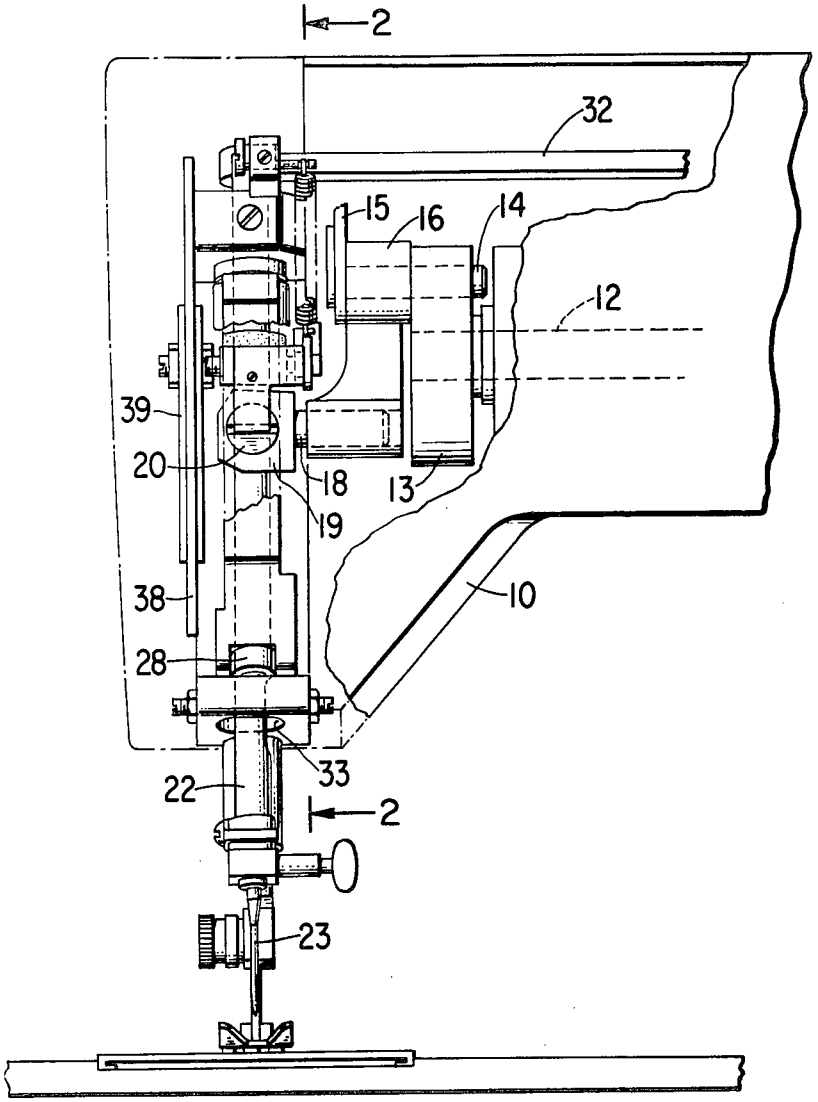
FIG. 1 is a front elevational view, partially broken away, of a sewing head portion of a sewing machine.

In FIG. 1 is shown a head portion 10 of a sewing machine partially broken away to disclose the mechanism supported therein. Within the head portion 10 there is shown an arm shaft 12 which terminates in a crank 13, the crank being connected by pin 14 to a connecting rod 16. Also partially shown is part of a takeup mechanism 15 which is also actuated by the crank 13. The connecting rod 16 carries a driving stud 18, which driving stud has cheek pieces 19 straddling a needle bar 22. The cheek pieces 19 of the driving stud 18 support therein a driving stud hinge pin 20 which encircles and freely slides upon the needle bar 22.

Figure 2:
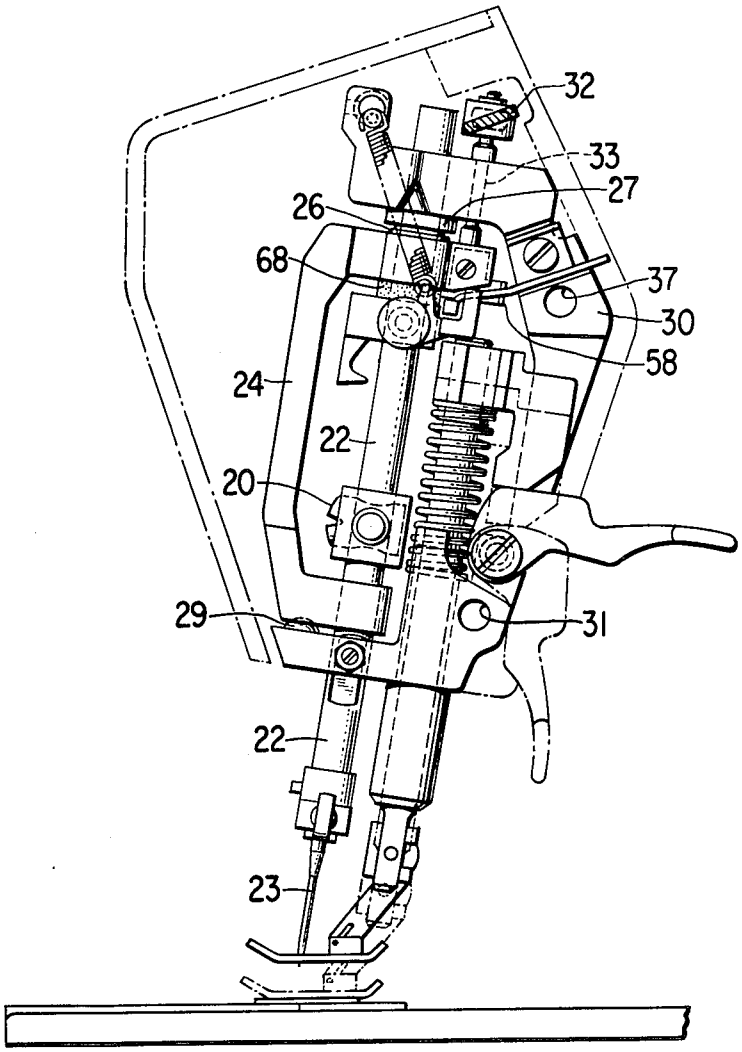
FIG. 2 is an elevational view of the sewing head portion taken along line 2—2 of FIG. 1 to show the head portion detached from the sewing machine and viewed from the interior thereof and showing the needle bar detached from the driving mechanism.

Referring to FIG. 2 it can be seen that the needle bar 22 is supported in a needle bar gate 24 for endwise reciprocatory movement in bearings 26, 28 (see also FIG. 1). In addition to its hollow interior support of the needle bar 22, the bearing 26 is fashioned wit a spherical outer portion for engagement with socket 27 carried in bracket 30 which may be attached to the sewing machine head portion 10 by screws (not shown) extending through apertures 31. The lower end of the needle bar gate 24 carries a socket bearing 28 (see FIG. 1) which coacts with spherical head 29 fastened to the bracket 30 so that swinging of the gate 24 occasioned by cam or motor actuated reciprocations of a driving arm 32 extended to the gate by pin 33 will cause lateral motion of the needle bar 22 accommodated by a slot 33 in the lower portion of the bracket 30.

Figure 3:
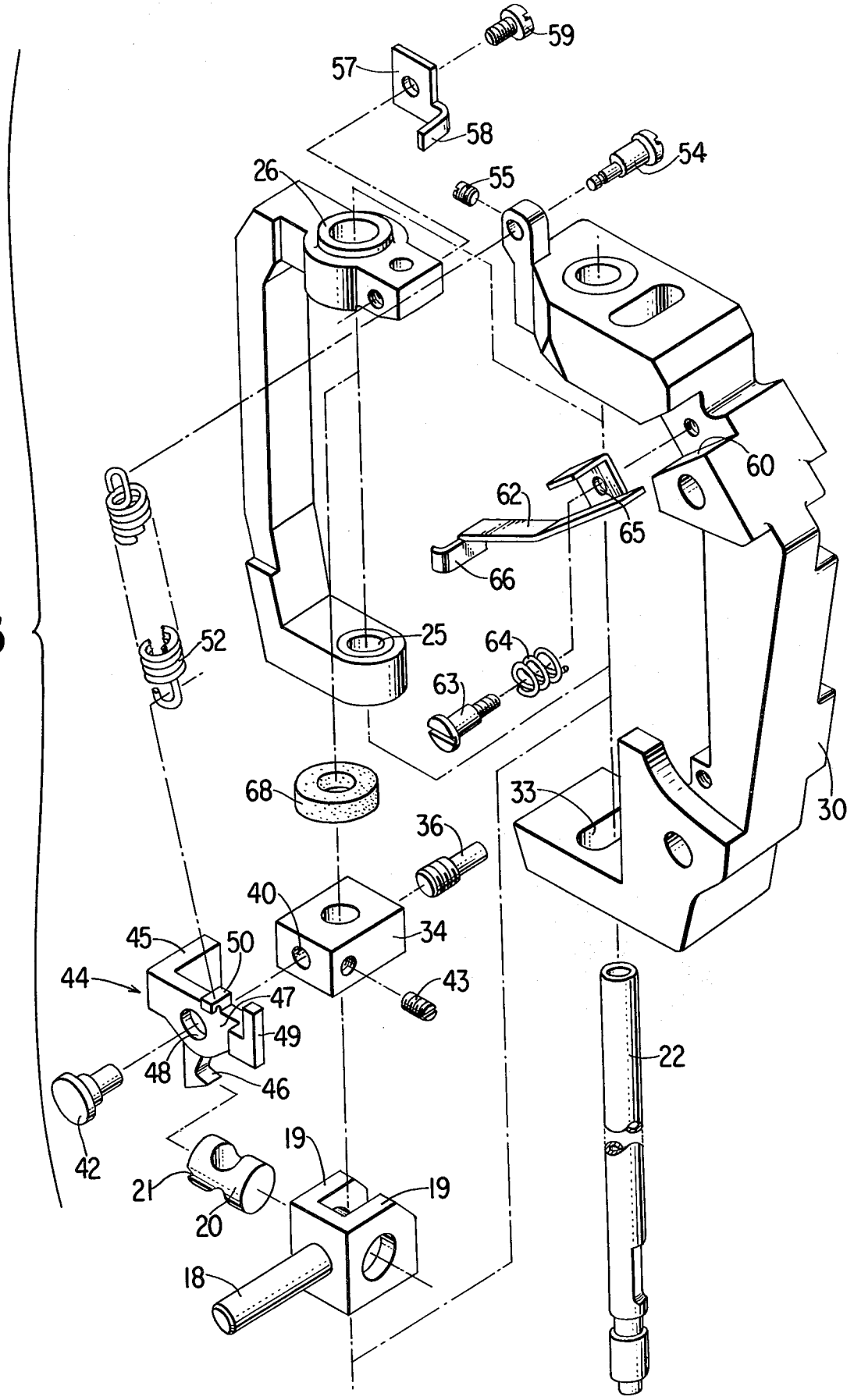
FIG. 3 is a perspective exploded view of the needle bar gate and head end arrangement.

Situated above the driving stud 18 on the needle bar 22 is a needle bar carrier 34 which is most clearly visible in FIG. 3. The needle bar carrier 34 is fastened to the needle bar 22 by means of stud 36 which stud has an elongated end for extension through a slot in a plate 38 (see FIG. 1) so as to maintain the needle bar, and sewing needle 23 affixed to the end thereof, in proper alignment for cooperation with a loop taker (not shown) supported in the sewing machine bed. The slot in the plate 38 may be lined with a synthetic resin material 39 to insure a low friction contact of the stud therewith. Opposite the stud 36 on the needle bar carrier 34 there is an aperture 40 which accommodates an end of a shouldered head stud 42 which is retained therein by means of a set screw 43. A latch member 44 is accommodated on the shoulder of the shouldered headed stud 42, the latch member being formed with a forwardly extending portion 45 which extends laterally in front of the needle bar carrier 34 and extends downwardly adjacent the needle bar 22 to terminate in a wedge 46 directed inwardly towards the needle bar 22. The forward portion of the driving stud hinge pin 20 is formed with a notch 21 to accommodate the wedge 46 and provide a connection between the needle bar 22 and the driving stud 18. A rear portion 47 of the latch member 44 extends beyond the hole 48 therein accommodating the shouldered headed stud 42 and terminates in an upstanding cam finger 49 whose purpose will be explained below. Spaced on the rear portion 47 between the hole 48 and the cam finger 49 is a lug 50 for accommodating one end of an extension spring 52, the other end of which is accommodated on an eccentric stud 54 retained in an aperture on the top end of bracket 30 by a set screw 55. Thus, the needle bar 22 is retained in an elevated state by the extension spring 52 unless the wedge 46 of the latch member 44 is engaged with the notch 21 in the driving stud hinge pin 20 whereupon the needle bar is positioned by the driving stud under the influence of the crank 13. The force exerted by the extension spring 52 is the least when the needle bar 22 is in elevated position and increases as the needle bar progresses to is lower position to where the sewing needle 23 penetrates a work material and cooperates with a loop taker (not shown) supported in the bed of the sewing machine. Since the force on the extension spring 52 increases with downward motion of the needle bar 22, it is apparent that the connection between the needle bar 22 and the driving stud 18 becomes more firmly made as the needle bar descends because of the increasing torque to maintain this connection exerted by the extension spring on the latch member 44. Once the position of the lug 50 on the rear portion 47 of the latch member 44 is established, additional adjustment can be made to the amount of force exerted by the extension spring 52 by adjustment of the eccentric stud 54. By adjustment of the angle of notch 21 in the driving stud 20 and of the angle on the wedge 46 in the forward portion 45 of a latch member 44, the basting stitch mechanism may be accommodated to perform a safety function, that is to prevent additional movement of the needle bar 22 when the sewing needle 23 strikes an object which would generate sufficient resistance to additional motion to cause the wedge 46 to slip out of the notch 21 and allow the driving stud 18 and hinge pin 20 to slide on the needle bar without influencing further endwise motion thereof. Such an adjustment may be empirically determined to establish specific angles to be used.

Actuation of the basting mechanism may be implemented electromechanically by means of a solenoid which, through linkage, acts upon the cam finger 49 to unlatch the needle bar 22 from the driving stud 18. Alternatively, basting may take place upon a movement of the needle bar gate 24 beyond the range in which stitches are made. Such a device is disclosed in U.S. Pat. No. 4,327,654, issued on May 4, 1982. In the improved basting stitch mechanism subject of this invention, basting may be implemented by means of a bracket 57 attached by a screw 59 to the top end of the needle bar gate 24 as is visible in FIGS. 2 and 3. The bracket 30 is also slotted as at 60 to receive a sheet metal extension 62 wich is resiliently retained in the slot by means of a shouldered screw 63, the shoulder of which extends through a spring 64 and aperture 65 in the sheet metal extension to be threadedly received in the bracket. When the needle bar gate 24 swings to an extreme position the finger 58 of the bracket 57 impinges on an edge of the sheet metal extension 62 causing the sheet metal extension to deflect within the slot 60 to the extreme permitted by the compression of spring 64 so that the cam end 66 thereof engages the cam finger 49 and rotates the latch member 44 to remove the wedge 46 from the notch 21 in the driving stud hinge pin 20. The result is that the driving stud 18 and driving stud hinge pin 21 will reciprocate up and down the needle bar 22 without influencing endwise reciprocation thereof. Upon disengagement of the needle bar 22 from the driving stud 18 the extension spring 52 will draw the needle bar 22 to its uppermost elevation. A cushion washer 68 may be inserted between the needle bar carrier 34 and the top end of the needle bar gate 24 in order to insure the lowest possible noise and shock transfer to the needle bar gate as a result of this unlatching. It is apparent that if the needle bar gate 24 is rotated so that the finger 58 of the bracket 57 comes out of contact with the sheet metal extension 62, the curved end 66 thereof will not engage the cam finger 49 on the latch member 44 and the extension spring 52 will once again cause the wedge 46 on the end of the forward portion 45 reengage with the notch 21 on the driving stud hinge pin 20 when the driving stud 18 is elevated to its uppermost position.

In this arrangement, the spacing between the cheek pieces 19 and the needle bar carrier 34 is not critical since the connection is made between the center of the driving stud hinge pin 20 and the latch member 44, both of which incline with the needle bar 22. In the initial design of the latch member 44 the wedge 46 may be spaced sufficiently from the aperture 48 to insure that there will be adequate clearance between the driving stud and the needle bar carrier for all combinations of parts. The wedge 46 and the notch 21 may be designed so that there is no possibility for closing the gap between the cheek pieces 19 of the driving stud 18 and the bottom of the needle bar carrier 34.

Figures 4A, 4B, 5A, 5B:
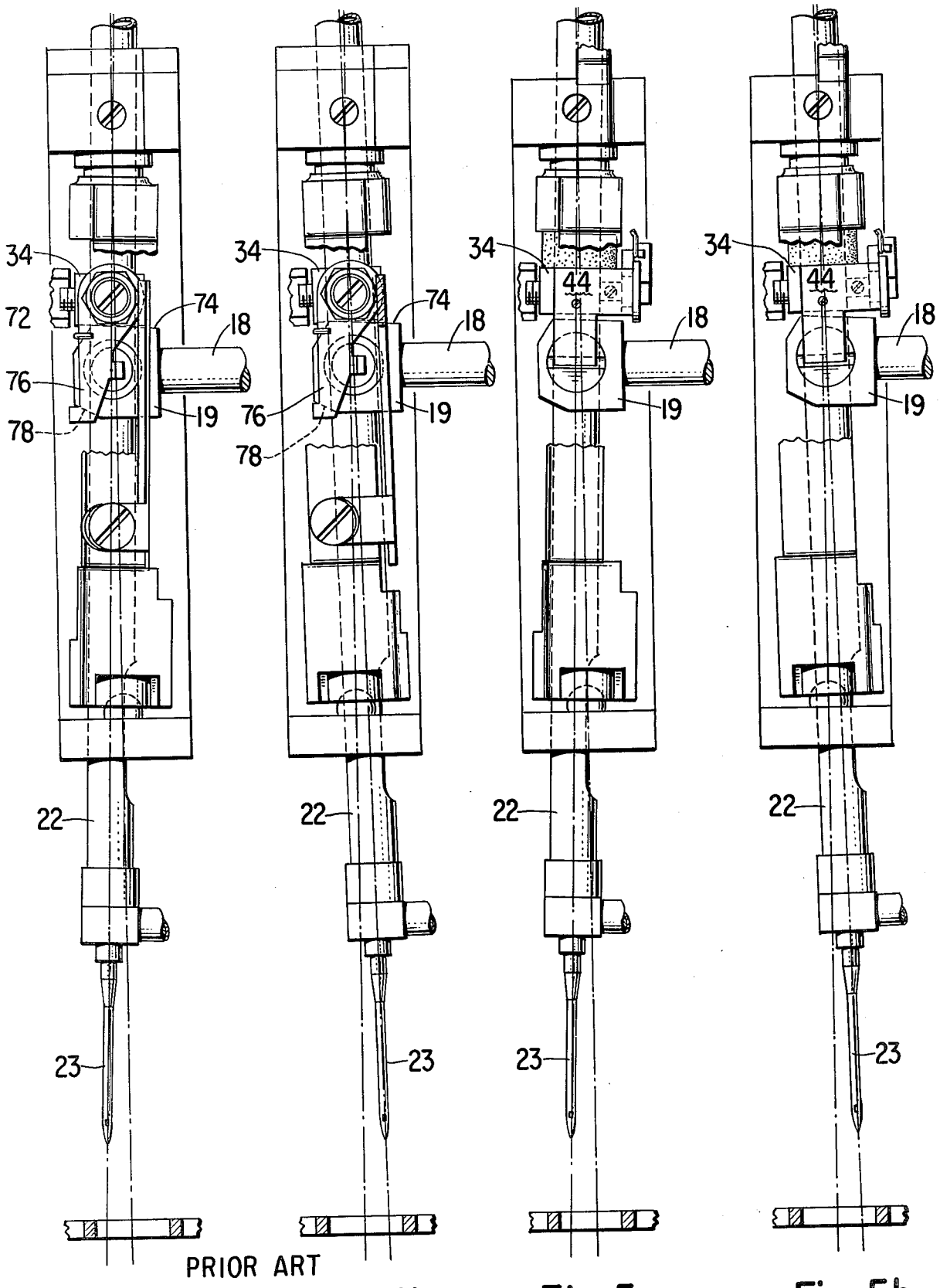
PRIOR ART Fig.4a Fig.4b Fig.5a Fig.5b
FIG. 4 is an elevation of a prior art needle bar and gate arrangement shown (a) in the left needle position and (b) in the right needle position; and, FIG. 5 is a front elevation of the improved needle bar and gate arrangement also shown (a) in the left needle position and (b) in the right needle position.

In FIGS. 4 *a* & *b* are shown the prior art devices in the left needle, and right needle position, respectively. Because of the connection of the driving stud 18 with the connecting rod 16, the driving stud 18 maintains a horizontal attitude regardless of the position of the needle bar 22. However, the needle bar carrier 34 which moves with the needle bar 22 maintains perpendicularity therewith. The result is that the bottom edge 72 of the needle bar carrier 34 inclines in opposite directions with respect to the top edge 74 of the cheek pieces 19 of the driving stud 18. Since the prior art latch 76 engages the driving stud 18 on the left front lower edge of the cheek pieces 19 as at 78, it may be seen that clearance must be provided between the needle bar carrier 34 and the cheek pieces 19 of the driving stud 18 to avoid an interference situation which would affect operation thereof, if not damaged parts.

Referring to FIGS. 5 *a* & *b* it may be seen that in the improved basting stitch mechanism a gap which exists between the needle bar carrier 34 and the cheek pieces 19 of the driving stud 18 is a result of the design of the latch member 44, and that the latch member moves with the needle bar 22 and the notch 21 in the driving stud hinge pin 20 also inclines with the needle bar.

It will be understood that various changes in the details, materials, arrangements of parts, and operating conditions which have been herein described and illustrated in order to explain the nature of the invention may be made by those skilled in the art within the principles and scope of the invention.

We claim:

1. A basting stitch mechanism for a sewing machine having a frame, an endwise reciprocable needle bar supported by said frame, an actuating mechanism carried in said sewing machine frame, said basting stitch mechanism comprising:

a latch mechanism carried by said needle bar, said latch mechanism including a needle bar carrier affixed to said needle bar, a latch member pivotally connected to said needle bar carrier and having at least a portion thereof extending adjacent said needle bar; means driven by said actuating mechanism for imparting endwise reciprocation to said needle bar through said latch mechanism, said imparting means including a wedge and a cooperating notch, both extending transversely of said endwise reciprocation; whereby, upon a selected resistence to motion of said needle bar, said wedge will slip out of said cooperating notch to separate said latch mechanism from said imparting means.

2. A basting stitch mechanism as claimed in claim 1 wherein said imparting means further comprises: a drive stud hinge pin slidably carried by said needle bar, and a driving stud for urging said driving stud hinge pin into endwise reciprocation on said needle bar; and means for connecting said adjacent portion of said latch member to the center portion of said driving stud hinge pin, said means including said wedge on said adjacent portion and said cooperating notch on said driving stud hinge pin.

3. A basting stitch mechanism as claimed in claim 2 wherein said latch member further comprises a rear portion on the side of the pivot connection to said needle bar carrier away from said adjacent portion, and an extension spring having one end connected to said rear portion and the other end connection to said frame above said latch member, whereby downward motion of said needle bar operates to increase the holding force on said latching means as said needle bar progresses to the bottom of its stroke.

4. A basting stitch mechanism for a sewing machine having a frame, an endwise reciprocating needle bar reciprocating from an upper position to a lower position and return, latching means carried on said needle bar, actuating mechanism carried in said sewing machine frame, means driven by said actuating mechanism for imparting endwise reciprocation to said needle bar through said latching means, the improvement comprising:

a means for increasing the holding force on said latching means as said needle bar progresses from said upper position to said lower position;

means for unlatching said needle bar from said imparting means on the imposition of resistance to continued motion of said needle bar sufficient to cause breakage of a sewing needle carried thereby.

5. A basting stitch mechanism as claimed in claim 4 wherein said latching means further comprises a needle bar carrier affixed to said needle bar and a latch member pivotably carried thereby with a portion adjacent said needle bar, wherein said actuating mechanism further comprises a driving stud hinge pin slidably carried by said needle bar and a driving stud carrying said hinge pin, and wherein said unlatching means further comprises a wedge and a cooperating notch, both extending transversely of said endwise reciprocating needle bar, a selected one on said driving stud hinge pin and the other on said latch member.

* * * * *